US007690525B2

(12) United States Patent
Schütz

(10) Patent No.: US 7,690,525 B2
(45) Date of Patent: Apr. 6, 2010

(54) SCREW CAP

(75) Inventor: Udo Schütz, Selters/Westerwald (DE)

(73) Assignee: Schütz GmbH & Co. KGaA, Selters/Westerwald (DE)

( * ) Notice: Subject to any disclaimer, the term of this patent is extended or adjusted under 35 U.S.C. 154(b) by 259 days.

(21) Appl. No.: 11/650,339

(22) Filed: Jan. 5, 2007

(65) Prior Publication Data

US 2007/0190827 A1 Aug. 16, 2007

(30) Foreign Application Priority Data

Oct. 14, 2006 (DE) ..... 20 2006 015 686 U

(51) Int. Cl.
*B65D 51/18* (2006.01)
*B65D 53/02* (2006.01)

(52) U.S. Cl. ..... 220/254.8; 220/203.28; 220/203.29; 220/214; 220/259.3; 220/259.4; 220/256.1; 220/303; 220/304; 220/367.1

(58) Field of Classification Search ..... 220/254.8, 220/203.29, 203.17, 254.2, 256.1, 367.1, 220/257.2, 203.09, 270, 214, 360, 371, 303, 220/259.2, 203.28, 259.3, 259.4, 304
See application file for complete search history.

(56) References Cited

U.S. PATENT DOCUMENTS

| | | | | |
|---|---|---|---|---|
| 3,393,823 | A * | 7/1968 | Dearing | 220/214 |
| 4,136,796 | A * | 1/1979 | Dubois et al. | 220/259.4 |
| 5,320,237 | A * | 6/1994 | Stolzman | 220/257.2 |
| 5,649,639 | A * | 7/1997 | Dolvet et al. | 220/257.1 |
| 2001/0011649 | A1 * | 8/2001 | Fujie et al. | 215/256 |
| 2006/0096985 | A1 * | 5/2006 | Stolzman | 220/276 |

FOREIGN PATENT DOCUMENTS

| | | |
|---|---|---|
| EP | 0 650 446 | 10/1996 |

* cited by examiner

*Primary Examiner*—Anthony Stashick
*Assistant Examiner*—Niki M Eloshway
(74) *Attorney, Agent, or Firm*—Friedrich Kueffner

(57) ABSTRACT

The screw cap of plastic for closing a filling and/or removal opening of a container for the transport and storage of liquids is equipped with a plug, in which a venting and aerating device is integrated. The screw cap has a sealing cap; and a protective cover, which completely covers the screw cap and protects the screw cap against contamination.

1 Claim, 3 Drawing Sheets

SCREW CAP

BACKGROUND OF THE INVENTION

1. Field of the Invention

The present invention relates to a screw cap with a cover disk provided with an internally threaded outer collar, attached at a right angle to the cover disk, for closing a filling and/or removal opening of a container for the transport and storage of liquids; with an internally threaded plug receptacle in a central, trough-like recess in the cover disk, a plug equipped with a vent device or a venting and aerating device being screwed into this receptacle; and with a sealing cap, which covers the plug.

2. Description of the Related Art

Screw caps of the general type in question as known from EP 0 650 446 B1 for closing the filling opening of a tight-head drum or of the inner plastic container of a palletized container with an external jacket of lattice bars or sheet metal suffer from the disadvantage that dirt can settle on the surface of the cap and, when the containers are stored outdoors, rainwater can collect in the trough-like recess in the cover disk in which the receptacle opening is located.

SUMMARY OF THE INVENTION

The invention is based on the object of improving the screw cap according to the state of the art in such a way that dirt deposits on the surface of the cap can be avoided.

This object is met according to the invention by a screw cap which has a protective cover.

By providing the screw cap with a detachable, reusable protective cover, which completely covers the screw cap, the screw cap is effectively protected from contamination and from the accumulation of water in the trough-like recess in the cap disk which contains the receptacle into which the plug containing the integrated venting and aerating device is screwed. On delivery to the buyer, the screw cap for closing the filling and/or removal opening of containers such as tight-head drums or palletized containers is provided with a protective cover. This protective cover can be removed by hand without any tools before an individual container is filled via the plug receptacle in the screw cap. If a large number of containers are to be filled by automatic filling machines, the protective cover can be removed by machine.

The various features of novelty which characterize the invention are pointed out with particularity in the claims annexed to and forming a part of the disclosure. For a better understanding of the invention, its operating advantages, specific objects attained by its use, reference should be had to the descriptive matter in which there are illustrated and described preferred embodiments of the invention.

DETAILED DESCRIPTION OF THE INVENTION

Figure 1:
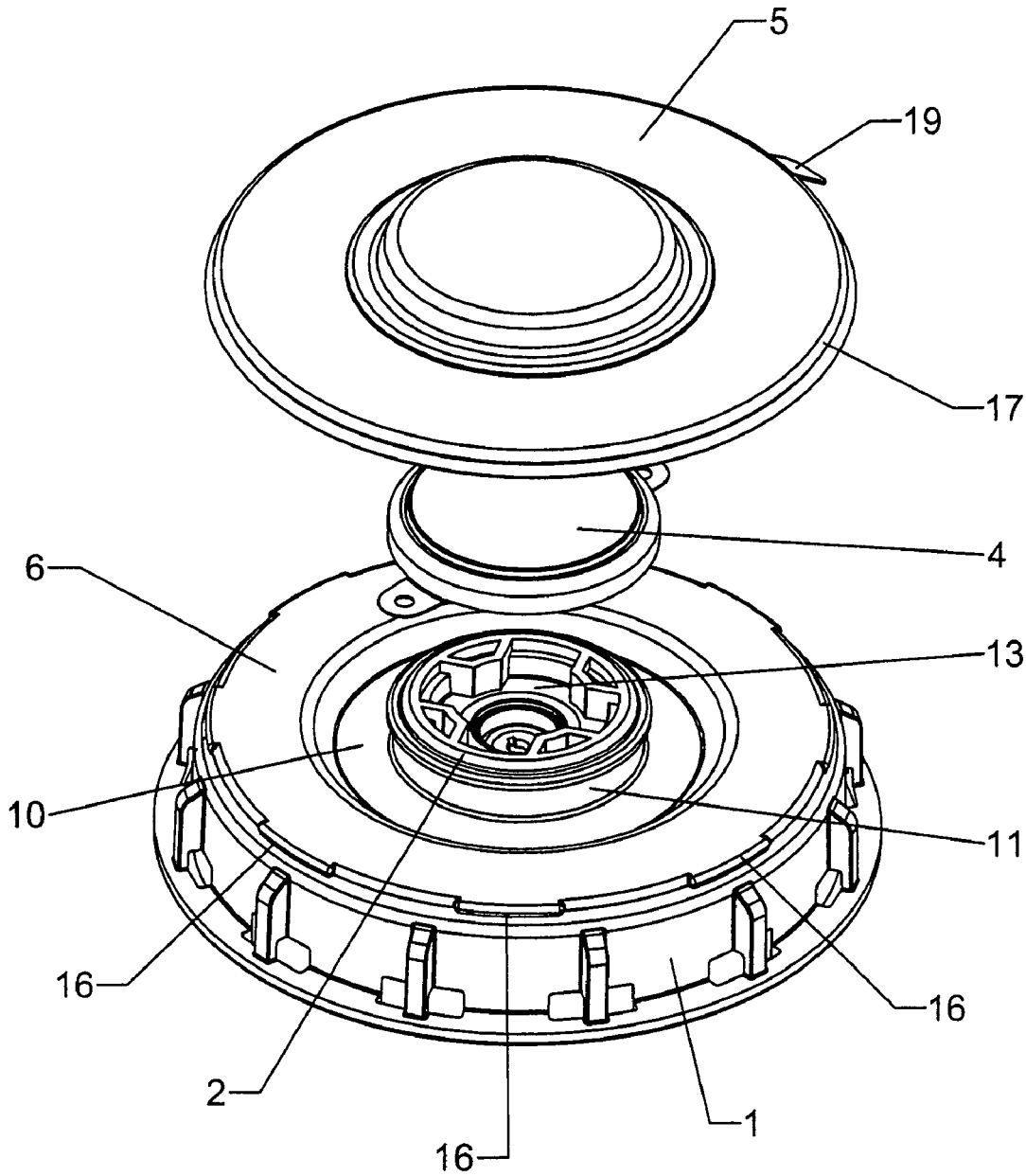
FIG. 1 is an exploded view of a screw cap showing its individual parts.

The screw cap 1 of plastic is provided with a plug 2, into which a venting and aerating device 3 is integrated;

with a sealing cap 4; and with a protective cover 5, which completely covers the screw cap 1.

The screw cap 1 has a flat cover disk 6, an outer collar 7 with an internal thread 8, the collar being attached at a right angle to the periphery of the disk to allow the screw cap to be screwed onto the filling and/or removal opening of a container for the transport and storage of liquids; and an inner collar 9, which is concentric to the outer collar 7 and serves to stiffen and to improve the seating of the screw cap on the filling and/or removal opening of the container.

A plug receptacle 11 with internal thread 12 is provided in a central, trough-like recess 10 in the cover disk 6 of the screw cap 1. The plug 2 with the integrated venting and aerating device 3 for releasing excess pressure or for compensating for a negative pressure in the liquid container is designed to be screwed into this receptacle. The plug 2 has an upper engagement slot 13 for a plug wrench, which is used to screw the plug into and out of the receptacle 11.

The sealing cap 4 attached to the plug receptacle 11 of the screw cap 1 serves to protect the plug 2 against unauthorized removal from the receptacle and can be removed only by destroying or breaking apart the plug receptacle.

Figure 2:
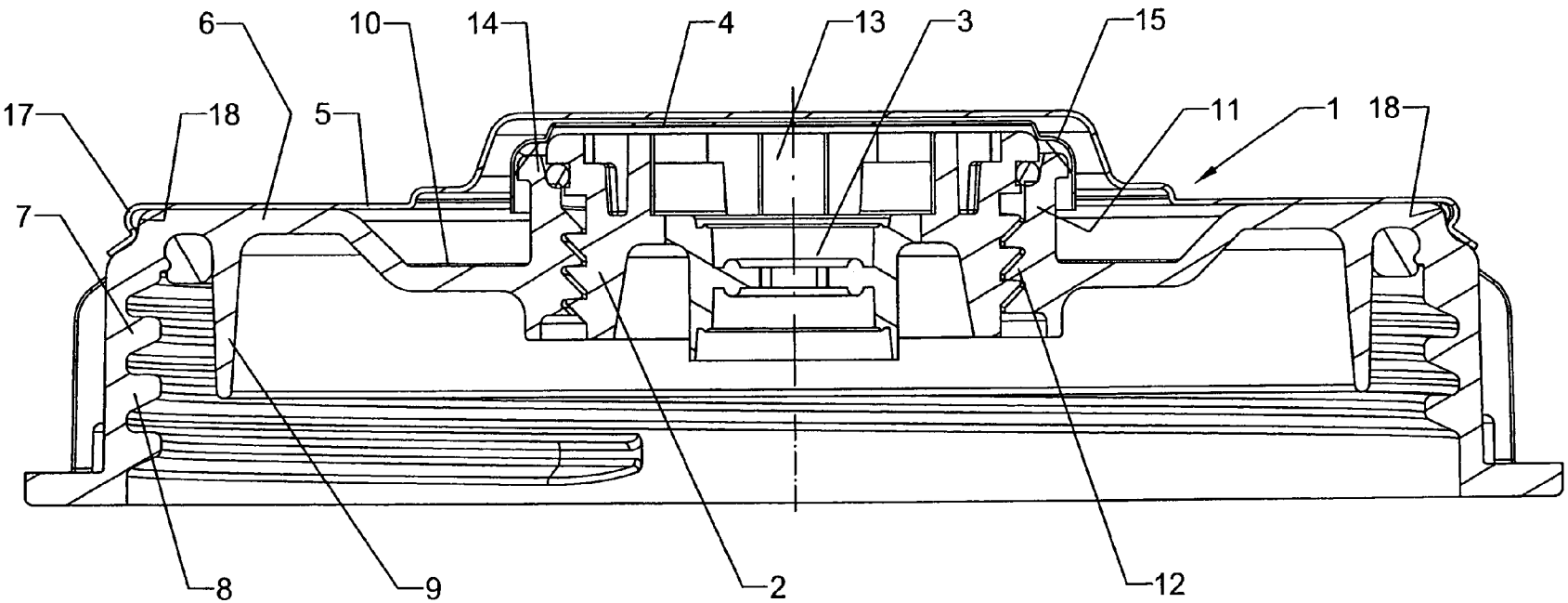
FIG. 2 is a longitudinal cross sectional view through the mounted screw cap equipped with a sealing cap of steel.

If the sealing cap is made of steel, the cap is clinched to the upper edge 14 of the plug receptacle 11 (FIG. 2).

Figure 3:
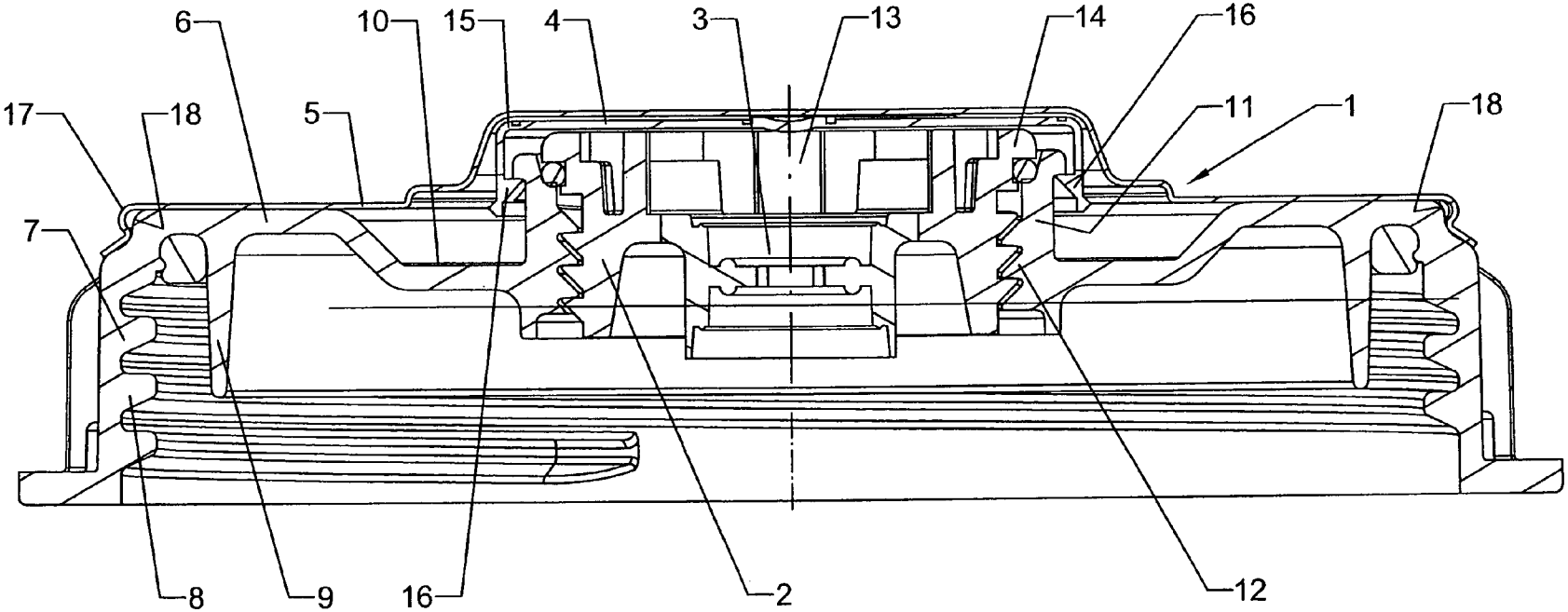
FIG. 3 is a view of a longitudinal carrier, similar to FIG. 2, of a screw cap equipped with a sealing cap of plastic.

A sealing cap 4 made of plastic has latching tabs 16 on the outer edge 15; these tabs latch onto the radially outward-projecting upper edge 14 of the plug receptacle 11 (FIG. 3).

The protective cover 5 for covering the screw cap 1 and thus protecting it from contamination is preferably made out of a transparent plastic material and has an outward-curving clamping rim 17, which allows the cap to be tightly clamped onto projections 18 arranged around the outer collar 7 of the screw cap 1.

A tab 19 formed on the clamping edge 17 of the protective cover 5 is used to pull the protective cover from the screw cap 1.

So that an individual container can be filled through the plug receptacle 11 of the screw cap 1 screwed onto the filling opening of the container, the protective cover 5 is first removed by hand without tools, and then the plug 2 is unscrewed from the plug receptacle 11 of the screw cap 1 by hand with a plug wrench. When a large number of containers are to be filled through the plug receptacle of the screw cap screwed onto the container filling opening in an automatic filling machine, the protective covers are removed by machine from the screw caps and the plugs are unscrewed by machine from the screw caps.

When a container is to be filled through its filling opening, the screw cap 1 together with the protective cover 5 is unscrewed from the filling opening.

While specific embodiments of the invention have been shown and described in detail to illustrate the inventive principles, it will be understood that the invention may be embodied otherwise without departing from such principles.

I claim:

1. A screw cap assembly, comprising a screw cap having a cover disk and an internally threaded outer collar attached at a right angle to the cover disk, adapted for closing a filling and/or removal opening of a container for the transport and storage of liquids; further comprising an internally threaded plug receptacle in a central, trough-like recess in the cover disk, a plug equipped with a vent device or a venting and aerating device being screwed into the receptacle;

a seal cap covering the plug; and a protective cover which is detachably connected to the screw cap to protect the screw cap against contamination, wherein the protective cap completely covers the screw cap, wherein the protective cover has an outwardly curved clamping edge, which allows the cover to be firmly clamped onto projections arranged around an outer collar of the screw cap, wherein a tab is formed on the clamping edge of the protective cover, the tab being used to pull the cover off the screw cap, wherein the protective cover is of plastic material.

* * * * *